US008485790B2

(12) United States Patent
Rumpf

(10) Patent No.: US 8,485,790 B2
(45) Date of Patent: Jul. 16, 2013

(54) FUEL SUPPLY UNIT FOR A MOTOR VEHICLE

(75) Inventor: Bernd Rumpf, Nidderau-Windecken (DE)

(73) Assignee: Continental Automotive GmbH, Hannover (DE)

( * ) Notice: Subject to any disclaimer, the term of this patent is extended or adjusted under 35 U.S.C. 154(b) by 1049 days.

(21) Appl. No.: 11/816,718

(22) PCT Filed: Jan. 10, 2006

(86) PCT No.: PCT/EP2006/050116
§ 371 (c)(1),
(2), (4) Date: Aug. 21, 2007

(87) PCT Pub. No.: WO2006/089814
PCT Pub. Date: Aug. 31, 2006

(65) Prior Publication Data
US 2008/0142097 A1 Jun. 19, 2008

(30) Foreign Application Priority Data
Feb. 23, 2005 (DE) ..... 10 2005 008 380

(51) Int. Cl.
*F04B 49/00* (2006.01)
*F04B 23/04* (2006.01)
*F02M 37/18* (2006.01)

(52) U.S. Cl.
USPC ..... 417/39; 417/79; 417/158; 123/497; 123/509

(58) Field of Classification Search
USPC . 417/36, 39, 53, 76, 79, 158, 211.5; 123/497, 123/509, 514; 137/565.23, 565.22, 574
See application file for complete search history.

(56) References Cited

U.S. PATENT DOCUMENTS

| | | | | |
|---|---|---|---|---|
| 6,240,902 | B1 | 6/2001 | Tanaka et al. | 123/463 |
| 6,708,673 | B2 | 3/2004 | Herzog et al. | 123/509 |
| 6,820,596 | B2 * | 11/2004 | Namari et al. | 123/501 |
| 7,082,931 | B2 | 8/2006 | Sinz | 123/509 |
| 7,353,807 | B2 * | 4/2008 | Paluszewski | 123/509 |

(Continued)

FOREIGN PATENT DOCUMENTS

| | | | |
|---|---|---|---|
| DE | 3115504 | A1 | 2/1982 |
| DE | 19951751 | A1 | 5/2001 |

(Continued)

OTHER PUBLICATIONS

English translation of EP 798457, Aug. 27, 2010, http://v3.espacenet.com/publicationDetails/description?CC=EP&NR=0798457A1&KC=A1&FT=D&date=19971001&DB=EPODOC&locale=en_EP.*

(Continued)

*Primary Examiner* — Devon Kramer
*Assistant Examiner* — Bryan Lettman
(74) *Attorney, Agent, or Firm* — King & Spalding L.L.P.

(57) ABSTRACT

A fuel-supply unit for a motor vehicle has a fuel container (2) that has several chambers (6, 7). The unit has a transfer pump (5) that is located inside the fuel container (2) for exclusively supplying ejector pumps (9, 10), which are positioned in the chambers (6, 7), with fuel as the pumping fluid. A primary fuel pump (4) that is located outside the fuel container (2) supplies an internal combustion engine (1) of the motor vehicle with fuel. The transfer pump (5) is operated discontinuously to prevent unnecessary power consumption.

19 Claims, 2 Drawing Sheets

U.S. PATENT DOCUMENTS

| | | | | |
|---|---|---|---|---|
| 7,644,873 | B2 * | 1/2010 | Doble et al. | 239/88 |
| 2003/0159681 | A1 * | 8/2003 | Schueler et al. | 123/514 |
| 2003/0226548 | A1 * | 12/2003 | Herzog et al. | 123/514 |
| 2004/0237941 | A1 * | 12/2004 | Sinz | 123/509 |
| 2005/0175481 | A1 * | 8/2005 | Harbuck | 417/416 |
| 2006/0065246 | A1 * | 3/2006 | Zdroik | 123/497 |

FOREIGN PATENT DOCUMENTS

| | | | |
|---|---|---|---|
| DE | 10005589 | | 8/2001 |
| DE | 10143819 | A1 | 4/2003 |
| DE | 4426685 | | 3/2004 |
| DE | 10317216 | A1 | 11/2004 |
| DE | 102004007718 | a | 10/2005 |
| EP | 0798457 | * | 10/1997 |
| EP | 0798457 | B1 | 11/2001 |
| EP | 1323567 | A2 | 7/2003 |
| JP | 60094819 | A | 5/1985 |
| JP | 60195222 | | 12/1985 |
| JP | 62283019 | A | 12/1987 |
| JP | 63115569 | | 7/1988 |
| JP | 7119572 | | 5/1995 |
| JP | 10318069 | A | 12/1998 |
| JP | 2003521617 | T | 7/2003 |
| JP | 2006022782 | A | 1/2006 |
| WO | 01/55582 | A1 | 1/2001 |

OTHER PUBLICATIONS

Japan Office Action (English translation), Japan patent application No. 2007-556577, 17 pages, Feb. 5, 2010.

* cited by examiner

FUEL SUPPLY UNIT FOR A MOTOR VEHICLE

CROSS-REFERENCE TO RELATED APPLICATIONS

This application is a U.S. national stage application of International Application No. PCT/EP2006/050116 filed Jan. 10, 2006, which designates the United States of America, and claims priority to German application number 10 2005 008 380.3 filed Feb. 23, 2005, the contents of which are hereby incorporated by reference in their entirety.

TECHNICAL FIELD

The invention relates to a fuel supply device for a motor vehicle having a fuel container and having a main fuel pump which is arranged outside the fuel container and has the purpose of sucking in fuel from the fuel container and of feeding the fuel to the internal combustion engine.

BACKGROUND

Such fuel supply devices are frequently used in contemporary motor vehicles in conjunction with fuel containers having a single chamber, and said fuel supply devices are known from practice. In contemporary fuel supply devices, fuel which is not required by the internal combustion engine is frequently fed back in a non-pressurized state into the fuel container. For this reason, it is not possible to connect to the return line any suction jet pumps which can feed fuel from a secondary chamber of the fuel container into a main chamber. However, fuel containers which have a plurality of chambers are frequently used, for example in motor vehicles with all wheel drive.

The possibility of using a transfer pump for supplying suction jet pumps arranged in the fuel container has already been considered. Continuous operation of the transfer pump results in a continuous noise level, a high level of power consumption and also in a short service life.

SUMMARY

A fuel supply device of the type mentioned at the beginning can be designed in such a way that it permits operation in conjunction with a fuel container which has a plurality of chambers.

According to an embodiment, a fuel supply device for a motor vehicle may comprise a fuel container, a main fuel pump which is arranged outside the fuel container for sucking in fuel from the fuel container and feeding the fuel to an internal combustion engine, suction jet pumps for feeding fuel from the chambers of the fuel container to an intake port of the main fuel pump, the suction jet pumps being arranged in said chambers, and an electrically driven transfer pump arranged within the fuel container, wherein a pressure side of the transfer pump is connected to nozzles of the suction jet pumps, and the transfer pump is switched discontinuously.

BRIEF DESCRIPTION OF THE DRAWINGS

The invention permits numerous embodiments. In order to clarify its basic principle further, two of said principles are illustrated in the drawing and will be described below. In said drawing.

DETAILED DESCRIPTION

Figure 1:
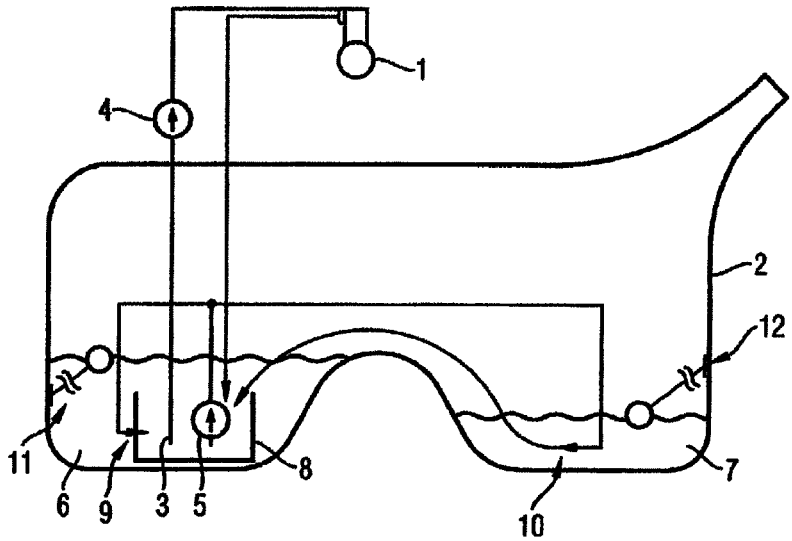
FIG. 1 is a schematic illustration of a fuel supply device according to an embodiment.

According to an embodiment, suction jet pumps for feeding fuel from the chambers of the fuel container to an intake port of the main fuel pump are arranged in said chambers, in that an electrically driven transfer pump is arranged within the fuel container, and in that a pressure side of the transfer pump is connected to nozzles of the suction jet pumps, and in that the transfer pump is switched discontinuously.

As a result of this configuration, the transfer pump permits a plurality of suction jet pumps to be supplied with fuel as the propellant and makes available the anticipated propellant pressure for the suction jet pumps. The fuel which is distributed in different chambers of the fuel container is therefore reliably fed to the intake port of the main fuel pump. Fuel which is possibly returned from the internal combustion engine can in this context be returned in an nonpressurized state into the fuel container at any desired point. The returned fuel is preferably fed to the intake port. An operating mode of the fuel supply system according to an embodiment which is particularly convenient for the users of the motor vehicle can be ensured if the transfer pump is switched discontinuously. As a result of this configuration, the transfer pump is switched off at anticipated times, which results not only in a reduction in the noise level caused by the transfer pump but also in lowering of the power consumption and in a long service life of the transfer pump.

The mounting of the fuel supply device according to an embodiment in the fuel container is particularly easy if the transfer pump and the intake port of the main fuel pump are arranged in a common surge pot. As a result, the transfer pump and the surge pot can be premounted as a premountable unit outside the fuel container.

According to another embodiment, reliable supply of fuel to the transfer pump can be easily ensured if the suction jet pumps open into the common surge pot.

Particularly low power consumption of the transfer pump can be easily ensured according to another embodiment if the transfer pump is controlled by means of filling level sensors which are arranged in the chambers of the fuel container. As a result of this configuration, the transfer pump remains permanently inactive when, for example, the fuel container is full and the fuel can flow independently of the chambers inside the fuel container. If the fuel is separated from the chambers when the fuel container is virtually empty, the transfer pump is switched on only when there is too little fuel at the intake port of the main fuel pump but sufficient fuel in another chamber. As a result, it becomes possible to control the transfer pump in a demand-dependent way in accordance with the filling levels of the fuel in the individual chambers.

Controlling the transfer pump by means of a level switch contributes to reducing the structural complexity of the fuel supply device according to an embodiment. As a result, the transfer pump remains continuously in the switched off state if sufficient fuel is present in the region of the intake port. Such level switches are generally known and they close or interrupt an electrical contact when the fuel exceeds or drops below a filling level.

The level switch is preferably arranged within the surge pot and/or within a connection of the chambers of the fuel container. As a result, it is possible to sense whether fuel is present near to the intake port of the main fuel pump or whether fuel can overflow from one chamber to the other chamber.

According to another advantageous development, the level switch is structurally particularly simple if it is embodied as a float switch.

The interruption of the feeding of the transfer pump, that is to say when sufficient fuel is present in the chamber which has the intake port of the main fuel pump, requires complex sensing and evaluation of filling levels in the fuel container. According to another embodiment, the discontinuous switching of the transfer pump requires particularly little expenditure if the transfer pump has an intermittent switching mode and if the intermittent switching mode is designed to generate an alternating power supply to the transfer pump for successive time periods. Such an intermittent switching mode permits clocked switching of the transfer pump so that an anticipated time period in which the transfer pump is operating is followed by a further anticipated time period in which the transfer pump is switched off.

According to another embodiment, it is easy to ensure that the suction jet pumps are fed sufficiently if the intermittent switching mode is the ratio of successive time periods of up to 1 to 10 or 20, wherein the power supply to the transfer pump is interrupted in the relatively long time period.

According to another advantageous development, the discontinuous switching of the transfer pump is structurally particularly simple if the transfer pump has an electronic control unit.

Connecting the electronic control unit to a relay which is arranged in a power supply of the transfer pump or a transistor circuit contributes to further simplifying the switching of the transfer pump.

If the control of the transfer pump fails, it is easily possible to ensure a sufficient supply of fuel to the main fuel pump if the relay or the transistor circuit causes the transfer pump to be supplied with power in the nonactuated state. This ensures an emergency operating property of the fuel supply system according to an embodiment.

FIG. 1 is a schematic view of a fuel supply device for supplying fuel to an internal combustion engine 1, which operates accordingly to the diesel principle, of a motor vehicle. The fuel supply device has a main fuel pump 4 which sucks in fuel via an intake port 3 which projects into a fuel container 2, and a transfer pump 5 which feeds fuel within the fuel container 2 to the intake port 3 of the main fuel pump 4. This main fuel pump 4 can be, for example, a mechanically driven diesel high pressure pump. The fuel container 2 is embodied as what is referred to as a saddle tank with two chambers. The main fuel pump 4 is arranged outside the fuel container 2, while the intake port 3 and the transfer pump 5 are arranged inside a surge pot 8 which is prestressed against the bottom of the fuel container 2. Suction jet pumps 9, 10 which are supplied with fuel as a propellant from the transfer pump 5 and which feed fuel from the chambers 6, 7 into the surge pot 8 are arranged in the chambers 6, 7. Furthermore, filling level sensors 11, 12 for measuring the filling level of fuel in the respective chambers 6, 7 are arranged in the chambers 6, 7.

Figure 2:
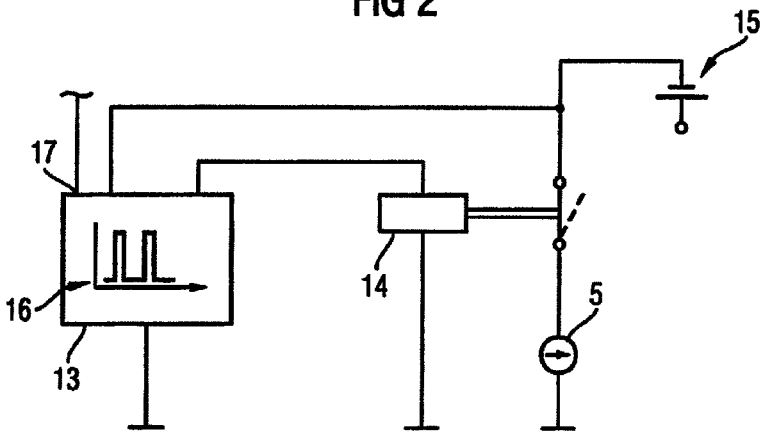
FIG. 2 is a schematic view of a circuit diagram relating to the means of actuating a transfer pump of the fuel supply device from FIG. 1.

FIG. 2 is a schematic circuit diagram relating to the means of actuating the transfer pump 5 from FIG. 1. The transfer pump 5 is connected to a power source 15 via a relay 14 which can be actuated by a control unit 13. In the illustrated basic state, the connection is formed between the transfer pump 5 and the power source 15 so that if the control unit 13 fails the transfer pump 5 is continuously supplied with electrical current and it is ensured that fuel is fed to the intake port 3 illustrated in FIG. 1. The control unit 13 has an intermittent switching mode 16 according to which the relay 14 is actuated after an anticipated first time period and the power supply to the transfer pump 5 is interrupted for an anticipated second time period. This second time period is followed in turn by the first time period in which the transfer pump 5 is actuated. The ratio of the first time period to the second time period is, for example, 1 to 10 so that the transfer pump 5 is switched off for most of the time. Furthermore, the control unit 13 has an input 17 for signals of the filling level sensors 11, 12. As a result, the transfer pump 5 can, for example, be switched off if the fuel container 2 is completely filled with fuel and fuel can overflow from one chamber 6 into the other chamber 7. Alternatively, the control unit 13 can also evaluate the signals of the filling level sensors 11, 12 in the individual chambers 6, 7 and activate the transfer pump 5 only if the chamber 5 which has the surge pot 8 has virtually no fuel but other chambers have sufficient fuel.

Figure 3:
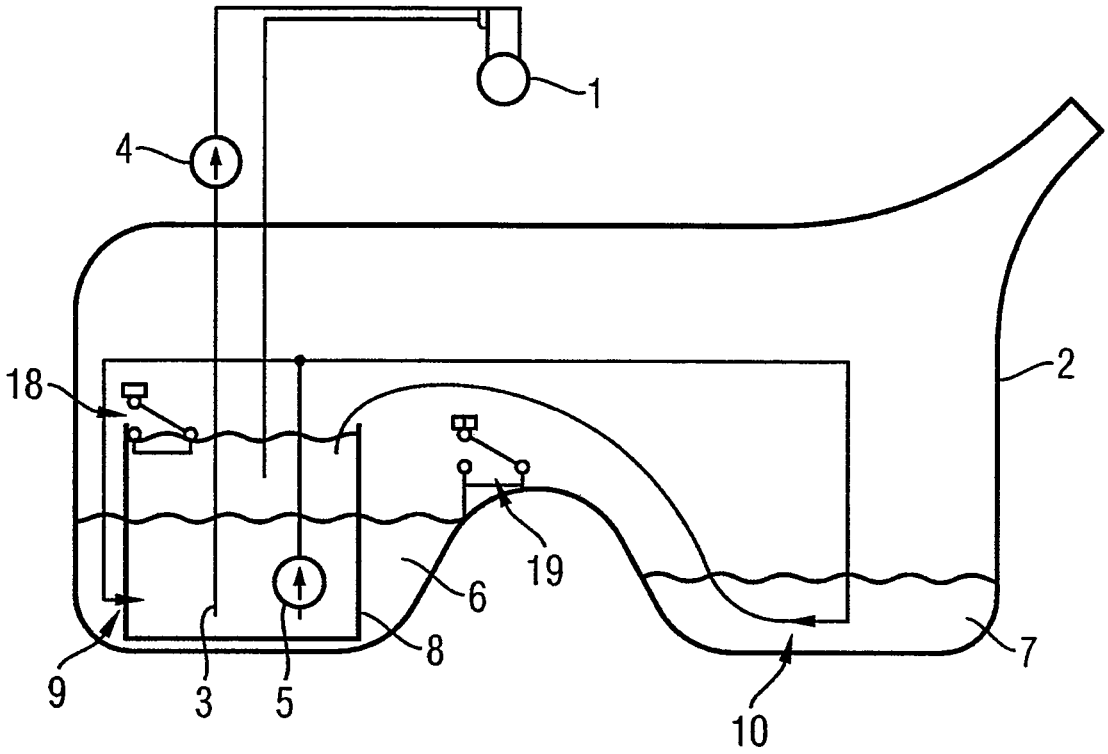
FIG. 3 is a further schematic illustration of the fuel supply device according to an embodiment.

FIG. 3 shows a further embodiment of the fuel supply device which differs from that in FIG. 1 only in that a level switch 18, 19 is arranged at the upper edge of the surge pot 8 and within the fuel container 2, respectively. The level switches 18, 19 are embodied as float switches. The transfer pump 5 can be actuated using the signals from the level switches 18, 19 in that, for example, the transfer pump 5 is continuously switched off when the surge pot 8 is filled with fuel. If the filling level in the surge pot 8 drops below the filling level which is provided for the switching of the level switch 18 in the surge pot 8, the transfer pump 5 can be activated. The level switch 19 in the fuel container 2 makes it possible to sense whether fuel can flow to and fro between the chambers 6, 7. In this case, it is not necessary to activate the transfer pump 8 and it is possible to prevent it. Here, as in the first embodiment, the transfer pump 8 can be activated with the control unit 13 according to FIG. 2 in an intermittent switching mode or a timed switching mode in which the transfer pump 8 is activated for a minimum time period of, for example, 60 seconds. For this purpose, signals from the level switches 18, 19 are fed to the control unit 13 via the input 17.

What is claimed is:

1. A fuel supply device for a motor vehicle comprising:

a fuel container including a plurality of chambers, a main fuel pump which is arranged outside the fuel container for sucking in fuel from the fuel container and feeding the fuel to an internal combustion engine, suction jet pumps for feeding fuel from the plurality of chambers of the fuel container to an intake port of the main fuel pump, the suction jet pumps being arranged in said plurality of chambers, filling level sensors disposed in the plurality of chambers of the fuel container, an electrically driven transfer pump arranged within the fuel container, wherein a pressure side of the electrically driven transfer pump is connected to nozzles of the suction jet pumps, and the electrically driven transfer pump is switched discontinuously, and a control unit configured to implement an intermittent switching mode in which the electrically driven transfer pump is switched in an alternating manner between actuated periods in which power is supplied to the electrically driven transfer pump and non-actuated periods in which power is not supplied to the electrically driven transfer pump, wherein the time durations of the actuated periods and non-actuated periods are predetermined, wherein during actuated periods of the transfer pump fuel is pumped towards the main fuel pump, whereas during non-actuated periods of the transfer pump fuel is not pumped towards the main fuel pump, and wherein the control unit only activates the transfer pump if there is too little fuel at the intake port of the main fuel pump and sufficient fuel in at least one of the plurality of chambers.

2. The fuel supply device according to claim 1, wherein the electrically driven transfer pump and the intake port of the main fuel pump are arranged in a common surge pot.

3. The fuel supply device according to claim 2, wherein the suction jet pumps open into the common surge pot.

4. The fuel supply device according to claim 1, wherein the filling level sensors comprise a level switch.

5. The fuel supply device according to claim 4, wherein the level switch is arranged within a surge pot and/or within a connection of the chambers of the fuel container.

6. The fuel supply device according to claim 4, wherein the level switch is embodied as a float switch.

7. The fuel supply device according to claim 1, wherein the intermittent switching mode is designed to generate an alternating power supply to the electrically driven transfer pump for successive time periods.

8. The fuel supply device according to claim 7, wherein the intermittent switching mode defines successive powered and non-powered time periods, wherein power is provided from the power supply to the electrically driven transfer pump during each powered time period and power to the electrically driven transfer pump is interrupted during each non-powered time period, wherein a ratio of successive powered to non-powered time periods is up to 1 to 20.

9. The fuel supply device according to claim 1, wherein the control unit is an electronic control unit.

10. The fuel supply device according to claim 9, wherein the electronic control unit is connected to a relay which is arranged in a power supply for the electrically driven transfer pump or a transistor circuit.

11. The fuel supply device according to claim 10, wherein the relay or the transistor circuit causes the electrically driven transfer pump to be supplied with power in the actuated state.

12. A method for operating a fuel supply device for a motor vehicle comprising a fuel container having a plurality of chambers, a main fuel pump which is arranged outside the fuel container for sucking in fuel from the fuel container and feeding the fuel to an internal combustion engine, and suction jet pumps arranged in said plurality of chambers, the method comprising the steps of:

sensing a fuel level in the plurality of chambers; and only if there is insufficient fuel at an intake port of the main fuel pump and sufficient fuel in at least one of the plurality of chambers, then feeding fuel from the at least one of the plurality of chambers of the fuel container to the intake port of the main fuel pump by driving an electrically driven transfer pump arranged within the fuel container, wherein a pressure side of the electrically driven transfer pump is connected to nozzles of the suction jet pumps, and the electrically driven transfer pump is switched in an alternating manner between actuated periods and non-actuated periods, wherein during actuated periods of the transfer pump fuel is pumped towards the main fuel pump, whereas during non-actuated periods of the transfer pump fuel is not pumped towards the main fuel pump, and wherein the time durations of the actuated periods and non-actuated periods are predetermined.

13. The method according to claim 12, wherein the electrically driven transfer pump and the intake port of the main fuel pump are arranged in a common surge pot and wherein the suction jet pumps open into the common surge pot.

14. The method according to claim 12, further comprising the step of sensing the fuel level in the plurality of chambers by means of filling level sensors which are arranged in the plurality of chambers of the fuel container.

15. The method according to claim 14, wherein the filling level sensors comprise a level switch.

16. The method according to claim 15, wherein the level switch is arranged within a surge pot and/or within a connection of the chambers of the fuel container.

17. The method according to claim 12, wherein the electrically driven transfer pump has an intermittent switching mode, and the intermittent switching mode is designed to generate an alternating power supply to the electrically driven transfer pump for successive time periods.

18. The method according to claim 17, wherein the intermittent switching mode defines successive powered and non-powered time periods, wherein power is provided from the power supply to the electrically driven transfer pump during each powered time period and power to the electrically driven transfer pump is interrupted during each non-powered time period, wherein a ratio of successive powered to non-powered time periods is up to 1 to 20.

19. The method according to claim 12, wherein the electrically driven transfer pump has an electronic control unit connected to a relay or transistor circuit which is arranged in a power supply for the electrically driven transfer pump, wherein the relay or the transistor circuit causes the electrically driven transfer pump to be supplied with power in the actuated state.

* * * * *